US011299903B2

(12) United States Patent
Chi et al.

(10) Patent No.: US 11,299,903 B2
(45) Date of Patent: Apr. 12, 2022

(54) PRESTRESS-FREE SELF-CENTERING ENERGY-DISSIPATIVE TENSION-ONLY BRACE

(71) Applicant: YANGZHOU UNIVERSITY, Yangzhou (CN)

(72) Inventors: Pei Chi, Yangzhou (CN); Wenlong Tian, Yangzhou (CN); Dafu Cao, Yangzhou (CN); Kun Wang, Yangzhou (CN); Tong Xing, Yangzhou (CN)

(73) Assignee: YANGZHOU UNIVERSITY, Yangzhou (CN)

( * ) Notice: Subject to any disclaimer, the term of this patent is extended or adjusted under 35 U.S.C. 154(b) by 368 days.

(21) Appl. No.: 16/605,129

(22) PCT Filed: Dec. 14, 2018

(86) PCT No.: PCT/CN2018/121107

§ 371 (c)(1),
(2) Date: Oct. 14, 2019

(87) PCT Pub. No.: WO2020/103239

PCT Pub. Date: May 28, 2020

(65) Prior Publication Data

US 2022/0049519 A1 Feb. 17, 2022

(30) Foreign Application Priority Data

Nov. 19, 2018 (CN) ..... 201811376904.9
Nov. 19, 2018 (CN) ..... 201821908740.5

(51) Int. Cl.
*E04H 9/02* (2006.01)

(52) U.S. Cl.
CPC ..... *E04H 9/0237* (2020.05)

(58) Field of Classification Search
CPC ..... E04H 9/023; E04H 9/0235; E04H 9/024; E04H 9/027; E04H 9/021; E04H 9/00;
(Continued)

(56) References Cited

U.S. PATENT DOCUMENTS 2,053,226 A * 9/1936 Ruge ..... E04H 9/0237 52/693
3,418,768 A * 12/1968 Cardan ..... E04H 9/0235 188/312

(Continued)

*Primary Examiner* — Brian E Glessner
*Assistant Examiner* — Adam G Barlow
(74) *Attorney, Agent, or Firm* — CBM Patent Consulting, LLC

(57) ABSTRACT

A prestress-free self-centering energy-dissipative tension-only brace, including a self-centering mechanism, an energy dissipation mechanism, a force-limiting energy-dissipative mechanism, a high strength steel cable, and a sleeve. The self-centering mechanism includes a sliding end plate, a spring, and a connection rod. One end of the spring is connected and fixed to the inner wall of the sleeve, and the other end of the spring is connected with the sliding end plate. One end of the connection rod is anchored at the center of the sliding end plate, and the other end of the connection rod passes through a fixed end of the spring. The energy dissipation mechanism includes rotating shafts, rotating wheels, friction plates, chains, and a cross-shaped connecting piece.

9 Claims, 5 Drawing Sheets

(58) Field of Classification Search
CPC ..... E04B 1/98; F16C 7/06; F16F 7/09; F16F 9/3207; F16F 15/1204; F16F 2228/08
USPC ..... 52/167.1, 167.3, 167.4, 167.7, 167.8, 52/573.1; 267/66–69, 73, 74; 74/501.5, 74/502.4, 502.6
See application file for complete search history.

(56) References Cited

U.S. PATENT DOCUMENTS

| | | | | | |
|---|---|---|---|---|---|
| 5,158,270 | A * | 10/1992 | Lin | F16F 9/06 | 267/74 |
| 5,185,976 | A * | 2/1993 | Miyake | F16F 13/007 | 52/167.6 |
| 5,462,141 | A * | 10/1995 | Taylor | F16F 9/466 | 52/167.6 |
| 8,998,182 | B2 * | 4/2015 | Kim | F16F 15/067 | 52/167.3 |
| 10,954,685 | B1 * | 3/2021 | Guo | E04H 9/0237 | |
| 2012/0038091 | A1 * | 2/2012 | Tagawa | E04H 9/0237 | 267/136 |
| 2012/0167490 | A1 * | 7/2012 | Balducci | E04H 9/0237 | 52/167.3 |
| 2014/0183802 | A1 * | 7/2014 | Kim | E04H 9/027 | 267/140.13 |
| 2017/0009477 | A1 * | 1/2017 | Konishi | E04H 9/0237 | |
| 2017/0107734 | A1 * | 4/2017 | Gray | E04H 9/0237 | |
| 2018/0283487 | A1 * | 10/2018 | Hattori | F16F 3/02 | |
| 2021/0087841 | A1 * | 3/2021 | Fu | E04B 1/98 | |

* cited by examiner

PRESTRESS-FREE SELF-CENTERING ENERGY-DISSIPATIVE TENSION-ONLY BRACE

TECHNICAL FIELD

The present invention relates to a seismic mitigation device, and more particularly relates to a prestress-free self-centering energy-dissipative tension-only brace.

BACKGROUND ART

As an efficient lateral force resisting system, braced frames are widely used in the field of earthquake engineering. However, traditional braced frames often produce a relatively large residual deformation after a severe earthquake, which seriously endangers the safety of buildings and is difficult and costly to repair.

The self-centering braces are relatively novel bracing systems, which effectively address the drawback of the traditional braces that are difficult to repair after an earthquake. However, the existing self-centering braces generally adopt prestressing to achieve a self-centering capability with shortcomings listed as below: (1) applying prestressing is cumbersome, and the tension control stress is difficult to control accurately; (2) prestress loss is inevitable, which has an undesirable impact on the extent of self-centering; (3) a prestressed material has high mechanical requirements and thereby fiber reinforced plastics are generally adopted, which are expensive; (4) anchors often need special design and are difficult to install; and (5) lack of an effective protective mechanism when subjected to extremely rare earthquakes.

SUMMARY OF THE INVENTION

The objective of the present invention is to disclose a prestress-free self-centering energy-dissipative tension-only brace, which realizes a self-centering function without applying prestressing, restrains the increase of an internal force in the brace and increases energy dissipation to enhance the protection of structural members by a force-limiting energy-dissipative mechanism when subjected to extremely severe earthquake, and is simple in structure and easy to process, and reduces the manufacturing cost.

The technical solution is that a prestress-free self-centering energy-dissipative tension-only brace includes a self-centering mechanism, an energy dissipation mechanism, a force-limiting energy-dissipative mechanism, a high strength steel cable, and a sleeve.

The self-centering mechanism includes a sliding end plate, a spring, and a connection rod. One end of the spring is connected with the inner wall of the sleeve, and the other end of the spring is connected with the sliding end plate. One end of the connection rod is anchored to the sliding end plate, and the other end of the connection rod passes through a fixed end of the spring.

The energy dissipation mechanism includes chains, a cross-shaped connecting piece, rotating shafts, rotating wheels capable of rotating around the rotating shafts, and friction plates. The rotating shafts are fixed to the sleeve. The friction plates are arranged on two sides of the rotating wheels to pre-press the rotating wheels and are connected in series through the rotating shafts. The chains are connected with the two rotating wheels. Two sides of the cross-shaped connecting piece are respectively connected with the chains, and the other two sides of the cross-shaped connecting piece are respectively anchored to the connection rod and the high strength steel cable.

The force-limiting energy-dissipative mechanism is composed of a low-carbon-steel connection plate arranged inside the cross-shaped connecting piece. The low-carbon-steel connection plate is clamped and fixed to the cross-shaped connecting piece. The high strength steel cable penetrates through the cross-shaped connecting piece and is anchored to the low-carbon-steel connection plate. Under an earthquake exceeding the fortification intensity, a tensile force of the high strength steel cable is increased till the low-carbon-steel connection plate yields, thereby restraining the increase of tensile force in the brace, and meanwhile, the energy dissipation capacity is supplemented and provided to further protect the main structures.

Specifically, the low-carbon-steel connection plate is a "T"-shaped structure. A horizontal section of the "T"-shaped low-carbon-steel connection plate is clamped and fixed to the cross-shaped connecting piece, and a vertical section and the high strength steel cable are located on the same straight line. The high strength steel cable is connected with the vertical section of the low-carbon-steel connection plate.

Specifically, two sides of the friction plates are screwed up by bolts to establish pre-pressure between the friction plates and the rotating wheels. The rotating wheels include large chain wheels, and small chain wheels I and small chain wheels II which are pressed on two side surfaces of the large chain wheels. The friction plates are respectively arranged on two sides of end surfaces of the small chain wheels I and the small chain wheels II and press the end surfaces of the small chain wheels I and the small chain wheels II. The chains are meshed with outer teeth of the large chain wheels. When rotating, the large chain wheels drive the small chain wheels I and the small chain wheels II to rotate.

The large chain wheels are provided with inner teeth. Pawls are arranged on the small chain wheels I. The pawls can rotate, and take recesses of the inner teeth locked with the large chain wheels as initial positions. The small chain wheels I and the small chain wheels II are connected and rotate synchronously.

Through holes are formed in end parts of the pawls. Non-through-hole slots corresponding to the through holes are formed in the small chain wheels I. Cylinders are arranged on the small chain wheels II. The lengths of the cylinders are less than the widths of the large chain wheels. The cylinders pass through the through holes in the pawls and are inserted into the non-through-hole slots in the small chain wheels I and fixedly connected with the small chain wheels I.

Leaf springs are arranged on the small chain wheels I. Bottoms of the leaf springs are fixed on the small chain wheels I, and movable ends are in contact with the pawls.

Four rotating wheels and two chains are provided. Each chain is connected with two rotating wheels. The chains are symmetrically arranged on two sides of the cross-shaped connecting piece, and are fixedly connected with the cross-shaped connecting piece.

The rotating shafts are irregular pillar bodies, with cylinders in the middle and the same widths as the rotating wheels. Two sides of the cylinders are suddenly changed into rectangular pillar bodies with the same widths as the friction plates. Threads are formed on the two rear sides of the rotating shafts. Square bayonets are formed in end parts of the rotating shafts, and have sizes slightly less than the sizes of the threads. The rotating wheels are arranged on the middle cylinders in a sleeving manner. The friction plates are arranged on the suddenly changed rectangular pillar bodies in a sleeving manner.

The whole sleeve is approximate to a box shape. A partition arranged in the middle divides the sleeve into two parts for respectively installing the self-centering mechanism and the energy dissipation mechanism. A through hole is formed in the middle of the partition. A square bayonet is formed in a part of a side provided with the energy dissipation mechanism, so as to lock two ends of the rotating shafts. The side surface, provided with the square bayonet, of the sleeve is set to be openable to facilitate structure installation.

Beneficial effects are as follows: the prestress-free self-centering energy-dissipative tension-only brace provided by the present invention is novel in structure and clear in working mechanics, and is structurally formed by connecting the self-centering mechanism, the energy dissipation mechanism, the force-limiting energy-dissipative mechanism, the high strength steel cable, and the sleeve. Compared with an existing self-centering energy-dissipative brace, the prestress-free self-centering energy-dissipative tension-only brace has the following advantages.

(1) A self-centering function is realized without applying a prestress. Under the action of earthquakes, the brace is in repeated loading and unloading states, and the unloading is a brace's self-centering process. Due to the presence of the rotating wheels, in the loading process, the pawls lock the large chain wheels, and the large chain wheels and the small chain wheels I and II work synergistically, with a friction force of the friction plates; in the unloading process, the pawls cannot lock the large chain wheels, and the large chain wheels and the small chain wheels I and II do not affect each other, without the obstruction of the friction force; therefore, the elastic deformations of the spring and the high strength steel cable, are recovered, thereby realizing self-centering.

(2) By the arrangement of the force-limiting energy-dissipative mechanism, on the one hand, the brace effectively restrains the increase of the internal brace force under the earthquake exceeding the fortification intensity; and on the other hand, the energy dissipation capacity is further supplemented, so as to enhance the protection of main structural members such as braces, beams, and columns.

DETAILED DESCRIPTION OF THE INVENTION

Figure 1:
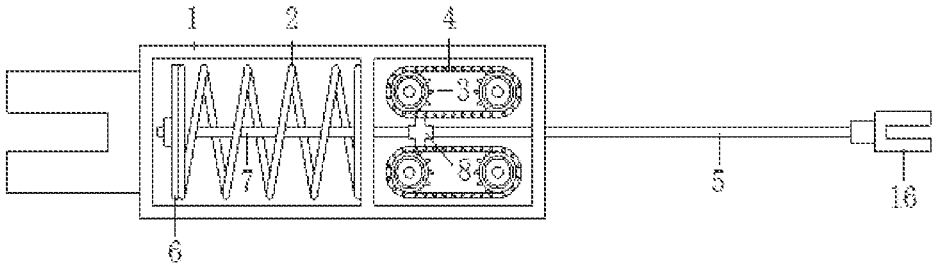
FIG. 1 is a front view of an overall structure of the present invention.

As shown in FIG. 1, a prestress-free self-centering energy-dissipative tension-only brace includes a self-centering mechanism, an energy dissipation mechanism, a force-limiting energy-dissipative mechanism, a high strength steel cable 5, and a sleeve 1.

As shown in FIG. 1, the whole sleeve 1 is approximate to a box shape. A partition arranged in the middle divides the sleeve 1 into two parts for respectively installing the self-centering mechanism and the energy dissipation mechanism. A through hole is formed in the middle of the partition. A square bayonet is formed in a part of a side with the energy dissipation mechanism, so as to lock two ends of rotating shafts 9. A side surface, provided with the square bayonet, of the sleeve 1 is set to be openable to facilitate structure installation.

Figure 2:
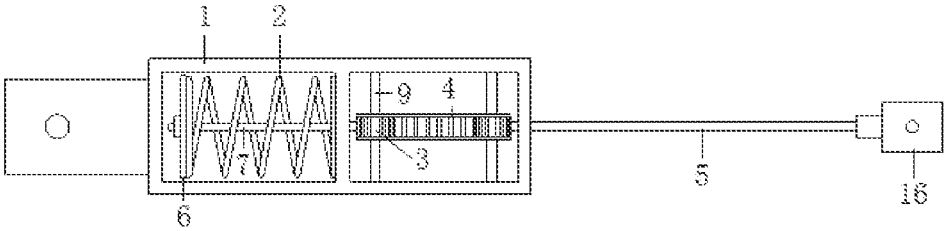
FIG. 2 is a top view of an overall structure of the present invention.

As shown in FIG. 1 and FIG. 2, the self-centering mechanism includes a sliding end plate 6, a spring 2, and a connection rod 7. One end of the spring 2 is fixedly connected with the inner wall of the sleeve 1, and the other end of the spring 2 is connected with the sliding end plate 6. One end of the connection rod 7 is anchored to the center of the sliding end plate 6, and the other end of the connection rod 7 passes through a fixed end of the spring 2.

As shown in FIG. 1 and FIG. 2, the energy dissipation mechanism includes chains 4, a cross-shaped connecting piece 8, the rotating shafts 9, rotating wheels 3 capable of rotating around the rotating shafts 9, and friction plates 13. The rotating shafts 9 are clamped and fixed to the sleeve 1. The friction plates 13 are arranged on two sides of the rotating wheels 3 to pre-press the rotating wheels 3, and the friction plates 13 and the rotating wheels 3 are connected in series through the rotating shafts 9. One chain 4 is connected with two rotating wheels 3. A total of four rotating wheels 3 and two chains 4 are provided. The chains 4 are symmetrically arranged on two sides of the cross-shaped connecting piece 8 and connected with the cross-shaped connecting piece 8. The other two sides of the cross-shaped connecting piece 8 are respectively anchored to the connection rod 7 and the high strength steel cable 5.

Figure 13:
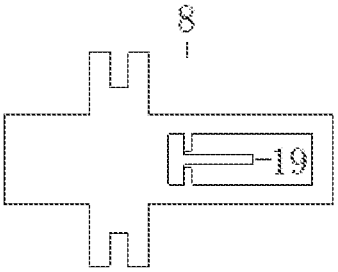
FIG. 13 is a planar structural schematic diagram of a cross-shaped connecting piece in the present invention.
Figure 14:
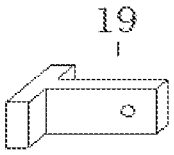
FIG. 14 is a three-dimensional structural schematic diagram of a low-carbon-steel connection plate.
Figure 15:
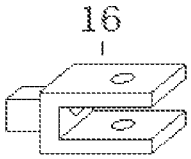
FIG. 15 is a three-dimensional structural schematic diagram of a steel cable connecting piece in the present invention.

As shown in FIG. 13, the force-limiting energy-dissipative mechanism is composed of a low-carbon-steel connection plate 19 arranged inside the cross-shaped connecting piece 8. The low-carbon-steel connection plate 19 is clamped and fixed to the cross-shaped connecting piece 8. The high strength steel cable 5 penetrates through the cross-shaped connecting piece 8 and is anchored to the low-carbon-steel connection plate 19. The low-carbon-steel connection plate 19 is of a "T"-shaped structure. A horizontal section of the "T"-shaped low-carbon-steel connection plate 19 is clamped and fixed to the cross-shaped connecting piece 8, and a vertical section and the high strength steel cable 5 are located on the same straight line. The high strength steel cable 5 is connected with the vertical section of the low-carbon-steel connection plate 19.

Figure 3:
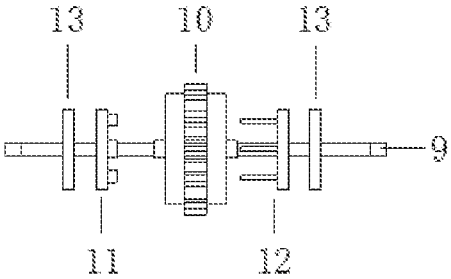
FIG. 3 is a structural schematic diagram of a rotating wheel in the present invention.
Figure 4:
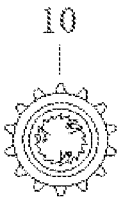
FIG. 4 is a structural schematic diagram of a large chain wheel and a small chain wheel I in the present invention.
Figure 5:
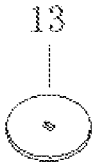
FIG. 5 is a three-dimensional structural schematic diagram of a friction plate in the present invention.
Figure 6:
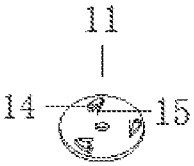
FIG. 6 is a three-dimensional structural schematic diagram of a small chain wheel I in the present invention.
Figure 7:
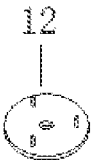
FIG. 7 is a three-dimensional structural schematic diagram of a small chain wheel II in the present invention.
Figure 8:
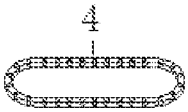
FIG. 8 is a three-dimensional structural schematic diagram of a chain in the present invention.

As shown in FIG. 3 and FIG. 4, two sides of the friction plates 13 are screwed up by bolts to establish pre-pressure between the friction plates 13 and the rotating wheels 3. The rotating wheels 3 include large chain wheels 10, and small chain wheels I 11 and small chain wheels II 12 which are pressed on two side surfaces of the large chain wheels 10. The diameters of inner tooth rings of the large chain wheels 10 are less than the outer diameters of the small chain wheels I 11 and the small chain wheels II 12. Circular concave platforms are arranged on two sides of the large chain wheels 10. The diameters of the inner circumferences of the circular concave platforms are greater than or equal to the outer diameters of the small chain wheels I 11 and the small chain wheels II 12. The small chain wheels I 11 and the small chain wheels II 12 are pressed tightly on the circular concave platforms. The friction plates 13 are respectively arranged on two sides of the end surfaces of the outer sides of the small chain wheels I 11 and the small chain wheels II 12 and tightly press the small chain wheels I 11 and the small chain wheels II 12. The chains 4 are meshed with the outer teeth of the large chain wheels 10. When rotating, the large chain wheels 10 drive the small chain wheels I 11 and the small chain wheels II 12 to rotate.

As shown in FIG. 4, the large chain wheels 10 are provided with inner teeth. Pawls 14 are arranged on the small chain wheels I 11. The pawls 14 can rotate, and take recesses of inner teeth locked with the large chain wheels 10 as initial positions. The small chain wheels I 11 and the small chain wheels II 12 are connected and rotate synchronously. Through holes are formed in end parts of the pawls 14. Non-through-hole slots corresponding to the through holes are formed in the small chain wheels I 11. Cylinders are arranged on the small chain wheels II 12. The diameters of the cylinders are equal to the diameters of the non-through-hole slots, and the lengths of the cylinders are less than the widths of the large chain wheels 10. The cylinders pass through the through holes in the pawls 14 and are inserted into the non-through-hole slots in the small chain wheels I 11 and fixedly connected with the small chain wheels I 11.

As shown in FIG. 4, leaf springs 15 are arranged on the small chain wheels I 11. Bottoms of the leaf springs 15 are fixed on the small chain wheels I 11, and the movable ends are in contact with the pawls 14, so as to limit the rotation of the pawls 14. Three pawls 14 and three leaf springs 15 are provided and uniformly distributed along the circumference.

Figure 9:
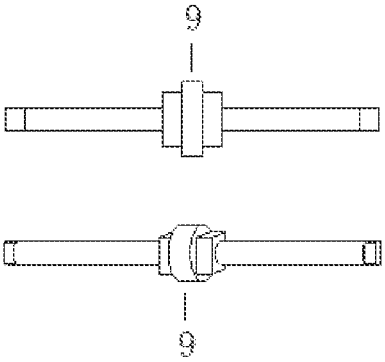
FIG. 9 is planar and three-dimensional structural schematic diagrams of a rotating shaft in the present invention.

As shown in FIG. 9, the rotating shafts 9 are irregular pillar bodies, with cylinders in the middle and the same widths as the rotating wheels 3. Two sides of the cylinders are suddenly changed into rectangular pillar bodies with the same widths as the friction plates. Threads are formed on the two rear sides thereof. Square bayonets are formed in end parts of the rotating shafts 9, and have sizes slightly less than the sizes of the threads. The rotating wheels 3 are arranged on the middle cylinders in a sleeving manner. The friction plates 13 are arranged on the suddenly changed rectangular pillar bodies in a sleeving manner.

Figure 10:
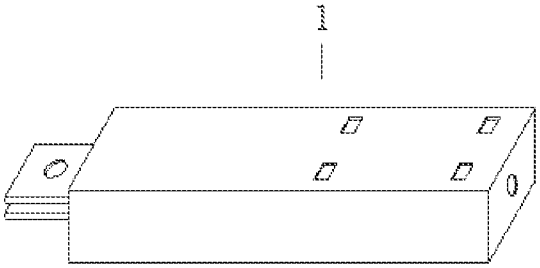
FIG. 10 is a three-dimensional structural schematic diagram of a sleeve in the present invention.
Figure 11:
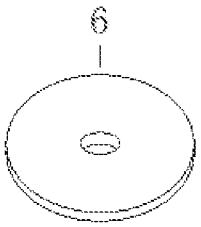
FIG. 11 is a three-dimensional structural schematic diagram of a sliding end plate in the present invention.
Figure 12:
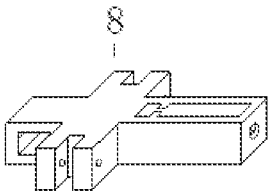
FIG. 12 is a three-dimensional structural schematic diagram of a cross-shaped connecting piece in the present invention.

As shown in FIG. 10, the whole sleeve 1 is approximate to a box shape. A partition arranged in the middle divides the sleeve 1 into two parts for respectively installing the self-centering mechanism and the energy dissipation mechanism. A through hole is formed in the middle of the partition. A square bayonet is formed in a part of a side with the energy dissipation mechanism, so as to lock two ends of rotating shafts 9. The side surface, provided with the square bayonet, of the sleeve 1 is set to be openable to facilitate structure installation.

As shown in FIGS. 1-16, the working mechanics of the above prestress-free self-centering energy-dissipative tension-only brace is as follows: the sleeve 1 is anchored to a building structure; one end of the spring 2 is connected with the sleeve 1, and the other end of the spring 2 is connected with the sliding end plate 6; the center of the sliding end plate 6 is anchored to the connection rod 7, and the connection rod 7 passes through the middle of the spring 2 and the other end, so as to be anchored to the cross-shaped connecting piece 8. Two sides of the cross-shaped connecting piece 8 are connected with the chains 4. The chains 4 are respectively connected with the two rotating wheels 3 that rotate around the rotating shafts 9 clamped in the sleeve 1. The rotating wheels 3 establish the pre-pressure between the friction plates 13 and the small chain wheels I 11 as well as the small chain wheels II 12 by bolts. The other end of the cross-shaped connecting piece 8 penetrates through the high strength steel cable 5. The high strength steel cable 5 is anchored to the low-carbon-steel connection plate 19. The low-carbon-steel connection plate 19 is clamped into the cross-shaped connecting piece 8. After penetrating through the sleeve 1, the other end of the high strength steel cable 5 is anchored to the building structure through a steel cable connecting piece 16.

Figure 16:
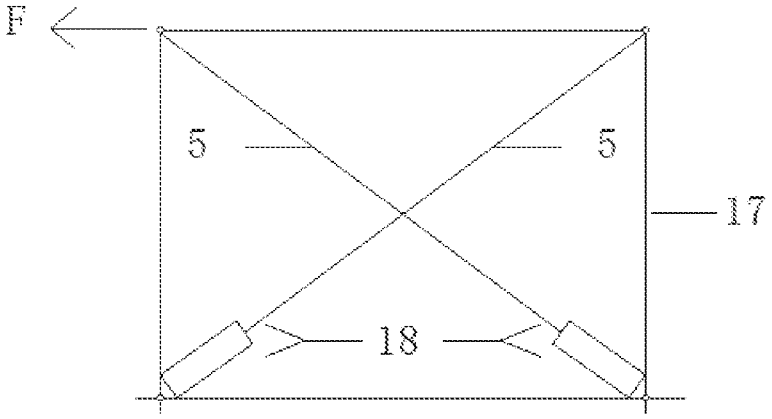
FIG. 16 is a schematic diagram of a building equipped with the present invention.

As shown in FIG. 16, the working process of the prestress-free self-centering energy-dissipative tension-only brace is as follows: the prestress-free self-centering energy-dissipative tension-only brace 18 is crisscross arranged in a desired building structure 17 along a diagonal direction. Under the load F as directed, the high strength steel cable 5 on the left side is elongated in tension and drives the energy dissipation mechanism and the self-centering mechanism of the prestress-free self-centering energy-dissipative tension-only brace 18 to work in sequence.

By the arrangement of the rotating wheel structures of the present invention, no friction force obstructs the self-centering of the brace, so that the spring and the high strength steel cable which are both in an elastic deformation range is recovered immediately to realize self-centering of the brace. By the arrangement of the low-carbon-steel connection plate, under the earthquake exceeding the fortification intensity, energy dissipation is effectively achieved owing to metallic yield, and the increase of the internal force of the brace is restrained, so as to enhance the protection of the main structural members such as braces, beams, and columns.

Preferably, the spring is a combination of disc springs.

Preferably, the low-carbon-steel connection plate is made of low-yield-point mild steel.

Under a minor earthquake, the tensile force in the high strength steel cable is transmitted to the large chain wheels through the chains; the large chain wheels are locked by the pawls and have a tendency to drive the small chain wheels I and the small chain wheels II to rotate, but at this time, since the friction forces between the small chain wheels I and the friction plates as well as the friction forces between the small chain wheels II and the friction plates are relatively large and are unlikely to be overcome, the end, anchored to the cross-shaped connecting piece, of the high strength steel cable is equivalent to a fixed end. Under this condition, only the high strength steel cable works.

Under moderate to major earthquakes, the tensile force of the high strength steel cable overcomes the friction force provided by the friction plates, so that the high strength steel cable pulls the cross-shaped connecting piece, and then pulls the spring to be compressed; at this time, the high strength steel cable and the spring are connected in series, and the overall axial stiffness of the brace is significantly reduced compared with the axial stiffness of the high strength steel cable, thereby restricting the rapid increase of the seismic forces induced in the building structure and achieving a protective effect on the building structure. Meanwhile, the chains drive the large chain wheels, and the large chain wheels drive the small chain wheels I and the small chain wheels II to rotate, and thus the seismic energy can be dissipated by the rotational friction which is developed between the small chain wheels I and the friction plate, and the small chain wheels II and the friction plates. After the earthquake, the tensile force of the high strength steel cable is continuously reduced, and the spring pulls the high strength steel cable to be recovered; at this time, the pawls no longer lock the large chain wheels, so as to eliminate the friction force obstruction; and therefore, the large chain wheels are pulled to move towards the initial positions till the spring is completely recovered, thereby realizing the self-centering function.

Under the earthquake exceeding the fortification intensity, the tensile force of the high strength steel cable is increased till the low-carbon-steel connection plate yields, thereby restraining the increase of the cable tensile force, and meanwhile, the energy dissipation capacity is supplemented and provided to further protect the brace as well as the building structure.

What is claimed is:

1. A prestress-free self-centering energy-dissipative tension-only brace, comprising a self-centering mechanism, an energy dissipation mechanism, a high strength steel cable (5), and a sleeve (1), wherein the self-centering mechanism comprises a sliding end plate (6), a spring (2), and a connection rod (7); one end of the spring (2) is connected with an inner wall of the sleeve (1), and another end of the spring (2) is connected with the sliding end plate (6); one end of the connection rod (7) is anchored to the sliding end plate (6), and another end of the connection rod passes through a fixed end of the spring (2);

the energy dissipation mechanism comprises chains (4), a cross-shaped connecting piece (8), rotating shafts (9), rotating wheels (3) capable of rotating around the rotating shafts (9), and friction plates (13); the rotating shafts (9) are fixed to the sleeve (1); the friction plates (13) are arranged on two sides of the rotating wheels (3) to pre-press the rotating wheels (3) and are connected in series through the rotating shafts (9); the chains (4) are connected with the two rotating wheels (3); two sides of the cross-shaped connecting piece (8) are connected with the chains (4), respectively, and other two sides of the cross-shaped connecting piece (8) are anchored to the connection rod (7) and the high strength steel cable (5), respectively.

2. The prestress-free self-centering energy-dissipative tension-only brace according to claim 1, wherein the prestress-free self-centering energy-dissipative tension-only brace further comprises a force-limiting energy-dissipative mechanism; the force-limiting energy-dissipative mechanism consists of a low-carbon-steel connection plate (19) arranged inside the cross-shaped connecting piece (8); the low-carbon-steel connection plate (19) is clamped and fixed to the cross-shaped connecting piece (8); the high strength steel cable (5) penetrates through the cross-shaped connecting piece (8) and is anchored to the low-carbon-steel connection plate (19).

3. The prestress-free self-centering energy-dissipative tension-only brace according to claim 2, wherein the low-carbon-steel connection plate (19) is a "T"-shaped structure; a horizontal section of the "T"-shaped low-carbon-steel connection plate (19) is clamped and fixed to the cross-shaped connecting piece (8), and a vertical section and the high strength steel cable (5) are located on the same straight line; and the high strength steel cable (5) is connected with a vertical section of the low-carbon-steel connection plate (19).

4. The prestress-free self-centering energy-dissipative tension-only brace according to claim 1, wherein two sides of the friction plates (13) are screwed up by bolts to establish pre-pressure between the friction plates (13) and the rotating wheels (3).

5. The prestress-free self-centering energy-dissipative tension-only brace according to claim 4, wherein the rotating wheels (3) comprise large chain wheels (10), and a first set of small chain wheels (11) and a second set of small chain wheels (12) which are pressed on two side surfaces of the large chain wheels (10); the friction plates (13) are respectively arranged on two sides of end surfaces of the first set of small chain wheels (11) and the second set of small chain wheels (12) and press the end surfaces of the first set of small chain wheels (11) and the second set of small chain wheels (12); the chains (4) are meshed with outer teeth of the large chain wheels (10); and when rotating, the large chain wheels (10) drive the first set of small chain wheels (11) and the second set of small chain wheels (12) to rotate.

6. The prestress-free self-centering energy-dissipative tension-only brace according to claim 5, wherein the large chain wheels (10) are provided with inner teeth; pawls (14) are arranged on the first set of small chain wheels (11); the pawls (14) can rotate, and take recesses of inner teeth locked with the large chain wheels (10) as initial positions; and the first set of small chain wheels (11) and the second set of small chain wheels (12) are connected and rotate synchronously.

7. The prestress-free self-centering energy-dissipative tension-only brace according to claim 6, wherein through holes are formed in end parts of the pawls (14); non-through-hole slots corresponding to the through holes are formed in the first set of small chain wheels (11).

8. The prestress-free self-centering energy-dissipative tension-only brace according to claim 6, wherein leaf springs (15) are arranged on the first set of small chain wheels (11); bottoms of the leaf springs (15) are fixed on the first set of small chain wheels (11), and movable ends are in contact with the pawls (14).

9. The prestress-free self-centering energy-dissipative tension-only brace according to claim 1, wherein four rotating wheels (3) and two chains (4) are provided; each chain (4) is connected with two rotating wheels (3); the chains (4) are symmetrically arranged on two sides of the cross-shaped connecting piece (8), and are fixedly connected with the cross-shaped connecting piece (8).

* * * * *